United States Patent [19]

Eriksson et al.

[11] Patent Number: 4,469,034

[45] Date of Patent: Sep. 4, 1984

[54] INCINERATION OF AND ENERGY RECOVERY FROM RELATIVELY INCOMBUSTIBLE WASTE, ESPECIALLY RUBBER AND PLASTIC

[75] Inventors: T. Lennart Eriksson, Vargön; Ebert Andersson, Trollhättan; Olle Nyström, Höganäs, all of Sweden

[73] Assignee: Volvo Flygmotor AB, Sweden

[21] Appl. No.: 478,446

[22] Filed: Mar. 24, 1983

Related U.S. Application Data

[63] Continuation-in-part of Ser. No. 226,683, Jan. 21, 1981, abandoned.

[30] Foreign Application Priority Data

Jan. 28, 1980 [SE] Sweden ..... 80006497

[51] Int. Cl.[3] ..... F23G 5/06

[52] U.S. Cl. ..... 110/346; 110/347; 110/244; 110/222; 122/22

[58] Field of Search ..... 110/243, 244, 222, 346, 110/347; 122/15, 22

[56] References Cited

U.S. PATENT DOCUMENTS

| | | | |
|---|---|---|---|
| 2,891,493 | 6/1959 | Gram, Jr. et al. | 110/235 |
| 3,777,677 | 12/1973 | Ali et al. | 110/244 |
| 3,797,413 | 3/1974 | Ali et al. | 110/244 |
| 3,826,208 | 7/1974 | Williams | 110/222 |
| 3,834,548 | 11/1974 | Bolejack, Jr. et al. | 110/222 |
| 4,057,021 | 11/1977 | Schoppe | 431/11 |
| 4,180,004 | 12/1979 | Johnson | 110/222 |
| 4,186,668 | 2/1980 | Tabel | 110/222 |
| 4,249,471 | 2/1981 | Gunnerman | 110/244 |
| 4,274,344 | 6/1981 | Nider | 110/244 |

*Primary Examiner*—Henry C. Yuen

*Attorney, Agent, or Firm*—Ostrolenk, Faber, Gerb & Soffen

[57] ABSTRACT

A plant for the incineration of waste, primarily from retreading shops, with the simultaneous use of the energy content of said waste for steam regeneration to operation and heating. The rubber waste is dosed in an amount dependent on the heat need of the shop with a screw to a grinder where it is ground down into small particles which, mixed with air, are blown into a furnace mounted onto the bottom of a steam boiler. By means of the blowing into the furnace as well as the blowing of flue gas at high temperature in the boiler taking place tangentially, a long period of stay for the burning particles is obtained, thus obtaining a total incineration. The outgoing flue gas is purified prior to release in the usual manner. The furnace is provided with an oil burner, which, in the event of a low energy need in the plant, has sole responsibility for steam regeneration over the oil system and control equipment. The plant is also suitable for less incombustible fuels and waste in powder or liquid form, for example, plastic waste, coal dust or biomass, the latter even mixed with water or oil, as well as solvents, tars, etc.

7 Claims, 2 Drawing Figures

Figure 1:
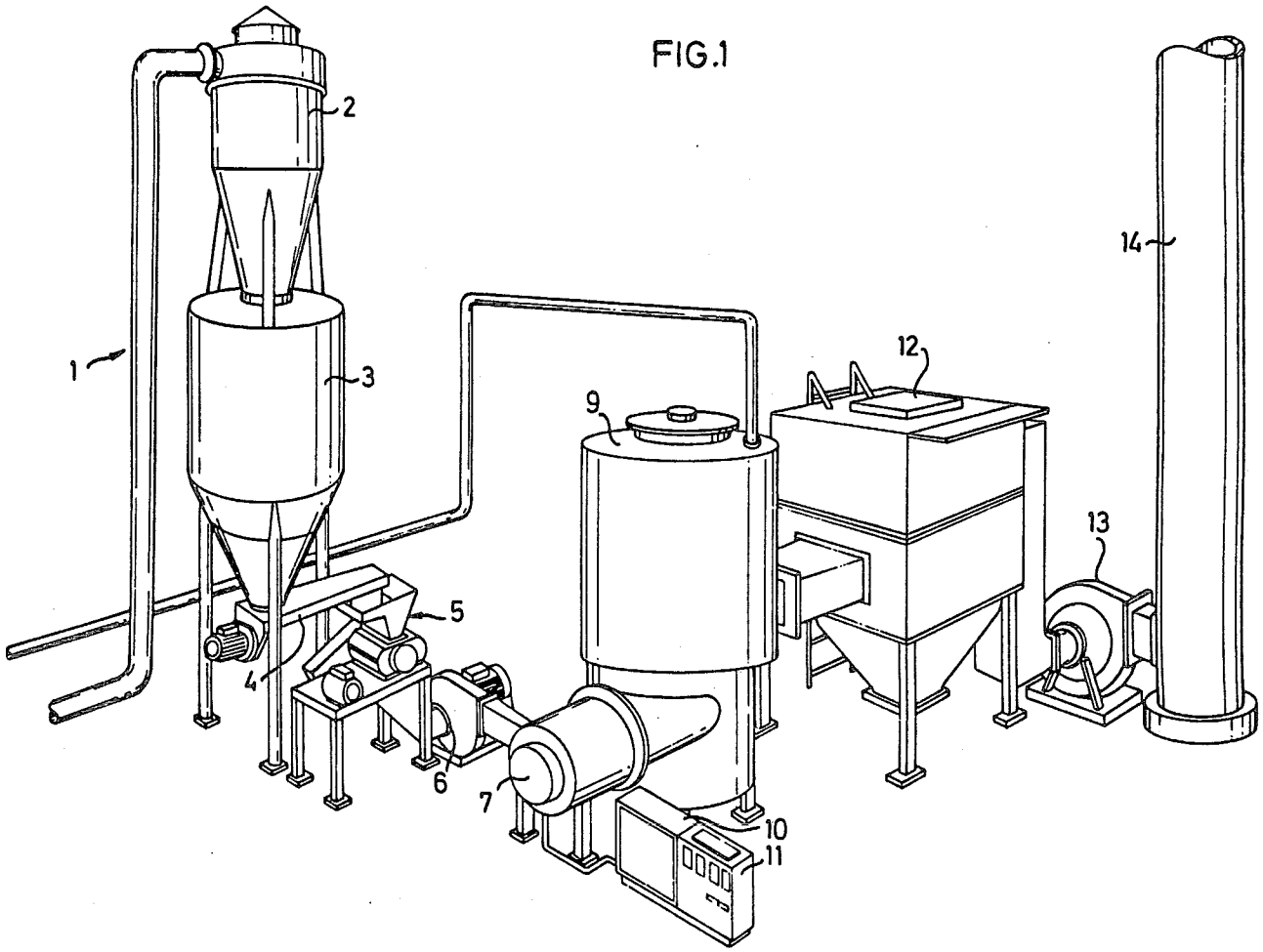

INCINERATION OF AND ENERGY RECOVERY FROM RELATIVELY INCOMBUSTIBLE WASTE, ESPECIALLY RUBBER AND PLASTIC

This is a continuation-in-part of application Ser. No. 226,683, filed Jan. 21, 1981, now abandoned.

The present invention relates to the incineration of and energy recovery from waste, preferably rubber waste from retreading shops. However, the invention can also be used with good results for a number of other fuels and waste materials in powdered or liquid form, such as plastic waste, coal dust or biomass, the latter also in mixtures with water or oil, as well as solvents, tars, etc.

Rubber waste, especially worn-out automobile tires, presents a very large waste handling problem, partly because rubber in general is hard to burn, handle or recycle and partly because the amount of waste in question is so great. A plurality of different methods such as incineration, cooling and grinding, pyrolysis, recycling in road surfacing, use in embankments, etc., have been tested both for destroying the rubber and recycling it.

Existing incineration plants are adapted for the incineration of whole or cut-up tires. By incineration, is meant flame combustion-oxidation with an excess of air and not pyrolysis or combustion in a fluidized bed. Flame combustion in existing incineration plants takes place at 800°-1000° C. with a great excess of air and, as a rule, in two steps. In the first step the rubber is subjected to pyrolysis in conjunction with the feed-in zone and in the second step the pyrolysis gas is subjected to a final combustion in a zone into which extra air and auxiliary fuel is added.

The furnaces can be single- or double-chamber furnaces, for example, furnaces having air supply in different zones, rotary ovens or furnace types having travelling gates followed by afterburners, etc.

A significant problem in using such incineration plants is that they produce about 300-350 ppm of nitrogen oxides (NOx) as measured in the output stack after combustion has occurred. In fluidized bed combustion, the NOx can be reduced to about 250 ppm. Such large amounts of NOx emissions are particularly undesirable.

Said previous incineration plants are very large units. However, when it comes to smaller amounts of rubber waste, for example, waste from retreading shops or the like, there is a need for rather small incineration plants which partly can ensure the advantageous use of rubber waste and partly deliver a large portion of the energy needed for operation of the plant. Retreading shops provide a waste product called rubber dross in an amount ranging from 50 up to several hundred kilos/-hour. Rubber dross is a mixture of fine rubber powder and approximately 1-2 cm long rubber strips cut from the old tire casing in a special drossing machine. Rubber dross has a great energy content, a heat value of approximately 9,500 kcal/kg, and can thereby be very suitable for steam regeneration and the like.

Technically speaking, it would naturally be fully possible to burn said rubber waste centrally in an existing type of incineration plant, but to this one would have to add the transport of rubber and the retreading plant would lose the relatively large energy content of the rubber waste.

In the incineration of rubber waste in an incineration plant according to the invention, the rubber dross is first ground into granules having a maximum particle size of 1.5-2 mm. The ground rubber dross is then sucked from the outlet of the grinder through a transport fan and pushed into a furnace where it is ignited by recirculated flue gas and subjected to a final combustion. The furnace has a special construction so as to retain the rubber granulate so long that an extensive combustion is able to take place at a high level of turbulence and high temperature, 1,200°-1,300° C.

The combustion chamber of the present invention permits one to achieve NOx emissions of about 115-130 ppm, i.e., much lower than achieved heretofor.

The furnace, which is the heart of the incineration plant, is in principle a cyclone furnace having a sophisticated air register for the addition of the combustion air. In this way, a carefully-controlled reflow into the furnace is obtained allowing the return of hot combustion gas to the primary zone so as to expedite overignition and final combustion.

The reflow is induced by the air register which provides the combustion air with a predominantly tangential component and thereby creates the possibility of extended period of stay for the fuel particles. The period of stay is also extended by means of a heavy outlet choke because of its reduced area opening. Said furnace construction makes possible an approximately 90% combustion of rubber ground to maximum 1.5-2 mm in a conventional rotary cutter. Incineration takes place at 1,200°-1,300° C. and at a lower excess of air than is normally used for rubber.

Conventional cyclone furnaces are very sensitive to the particle size which should be less than 0.5 mm. The burning speed of the fuel is also an important parameter. Rubber is one of those fuels which despite their high heat values have a low burning speed, i.e., due to the rubber polymer cross-links being hard to destroy, said cross-links originating from vulcanization with sulphur.

The connection to the boiler is also important for the incineration plant, the furnace and boiler cooperating as an integral unit. By means of the furnace being tangentially mounted onto the bottom part of the boiler, a rotation and turbulency is created which provides a final combustion of remaining soot and larger particles. By means of the high combustion temperature, a smaller boiler can be used for the same effective output than what would have been necessary in a conventional rubber incineration plant.

Figure 2:
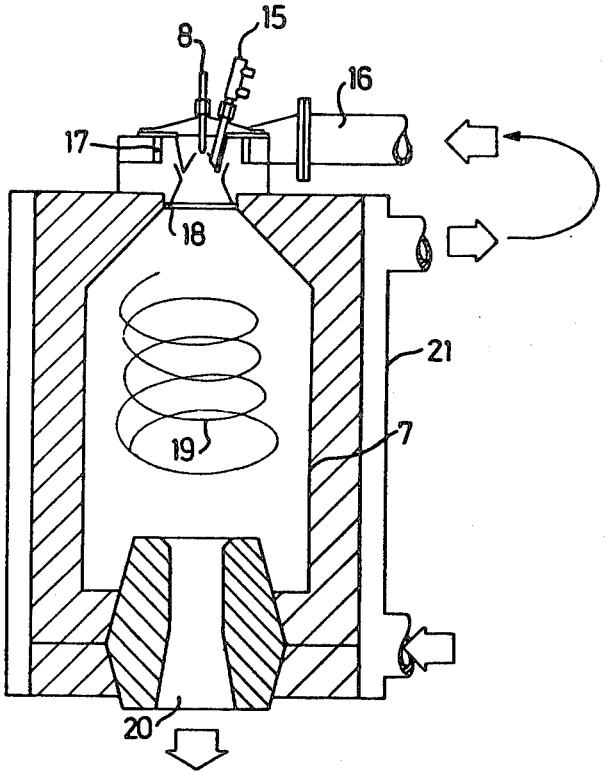

In order to further illuminate the invention, an example of a plant shall be described in detail in connection with the accompanying drawings of which FIG. 1 shows schematically an energy recovery plant for rubber waste and FIG. 2 is a furnace for the main incineration of the rubber particles.

Rubber dross is blown from the fan in a drossing machine (not shown here) through the pipe 1 to a cyclone 2 and is colected in a silo 3. The rubber dross is apportioned out from the silo by a vibrating screw feeder 4 to a grinder 5 which grinds the rubber to a granulate having a maximum particle size of 1.5-2 mm.

The ground rubber is sucked from the outlet of the grinder by a transport fan 6 and is pushed into the furnace 7, the construction of which is described in more detail below. The rubber granulate is ignited in the furnace 7 and kept there until final combustion is at hand. The furnace is situated tangentially of and on the bottom end of a steam boiler 9 so that the hot exhaust is caused to rotate heavily resulting in a final combustion of the granulate. The primary and auxiliary fuel system 10 and incineration are controlled by control equipment 11. The hot exhaust generates steam and is led out to flue gas purifier 12 at a temperature of 200° C.

In the flue gas purifier 12, the flue gas is sucked by means of a flue gas fan 13 through a multicyclone apparatus or suppression filter for the separation of particles. The amount of flue gas is adjusted by a damper on the suction side and the purified flue gas is released through a tall chimney 14.

An example of a furnace 7 suitable for the plant according to the invention is shown in FIG. 2. Rubber dross is blown in through a spreader 15 and air which has been preheated in conjunction with the cooling of the casing 21 is tangentially added to a pressure of approximately 1,400 mm.vp through a pipe 16. The air passes through a register 17 where it assumes a rotating movement around a screen 18 having the shape of an hourglass. The air is introduced at a rate such that it is slightly in excess of the stoichiometric amount required for combustion, preferably about 1–7% excess oxygen (about 5–45% air). As a result of its introduction by the axially located air register 17, a portion of the air is caused to flow tangentially within furnace 7, cooling the walls and thus permitting radiation from the burning particles within furnace 7. This lowers the temperature of the burning particles which thereby reduces the amount of NOx produced. The wall cooling, however, is not excessive and the wall temperature is not so low that soot or coke formation occurs on the walls. The rubber dross and a portion of the air are mixed at the screen 18 and the mixture continues in a helical path 19 through the furnace 7. By means of the spreader 15 being placed next to the central line of the furnace, the lighter particles are caught up in the helical movement while the heavier particles go directly to the downstream section of the furnace 7. They are there caught up in the helical movement. Thus, one obtains a selective distribution of the powder. An oil burner 8, an ignition burner and a flame monitor lead into the helical screen. The rubber dross is ignited by the hot flame just below the edge of the screen 18 and, by means of its helical path, remains in the furnace for quite a long time. The flue gas is blown out through the opening 20 in the furnace and tangentially into the bottom section of the boiler 9. The final combustion of unburned material, mainly larger particles, then takes place in the boiler as the flue gas moves upwards in a helical path. There is a stoichiometric deficiency of oxygen at the ignition zone of furnace 7, i.e., in the vicinity of screen 18, since a portion of the air flows tangentially along the walls. Some of the air flowing along the walls mixes with the helically flowing combustion mixture but the amount of $O_2$ in the mixture still remains stoichiometrically deficient. As a result, the combustion temperature is lower and the amount of NOx produced reduced. Opening 20 is a greatly reduced dimention relative to the cross-section of furnace 7. As a result of this choking, some of the combustion mixture is reflected back into the principle section of furnace 7, such reflow allowing additional burning, and the combustion mixture and wall air flowing through opening 20 are mixed so that there is about a stoichiometric amount of oxygen in opening 20. Chemical equilibrium would normally produce 1,500–2,000 ppm NOx but the residence time is so short that appreciable amounts of NOx are not formed. As a result of the foregoing arrangement of zones in furnace 7, combustion of particles takes place with a deficiency of oxygen and with simultaneous radiation of energy from the burning particles to the walls whose temperature is regulated to avoid soot or coke formation. The final combustion in boiler 9 is effected with a slight stoichiometric excess of oxygen and a homogeneous combustion mixture. The increased pressure drop which results from the passage through the restricted area opening 20 and expansion as the mixture enters boiler 9 improves the degree of mixing.

A typical plant can be as follows:

| | |
|---|---|
| waste silo | 2.7 $m^3$ |
| grinder | 100 Kg/h, 4 kW |
| transport fan | 600 mm vp, 4 kW |

Rubber powder 9,500 kcal/Kg. approx. 40 Kg/h nom was used as fuel in the furnace at full load.

The flue gas entering the boiler had an ingoing temperature of 1,200° C. and an outgoing temperature of 200° C., an overpressure of 600 mm wc and provided 500 Kg/h saturated steam at an overpressure of 6 bar.

The combustion fan provided a pressure of approximately 1,400 mm vp at a capacity of 800 $m^3$/h. The exhaust gas was purified in a multicyclone filter having eight cyclones and could then be released through a 15 meter high chimney.

In the combustion of rubber granulate, the combustion and flue gas fans are first started, after which the primary and auxiliary oil burners of the furnace are started. After a brief heating period, the silo vibrator, the feeder screw and the grinder are started and the combustion fan begins to blow the rubber into the furnace. The oil burner is shut off therewith. Combustion continues until the maximum operating pressure of the steam is achieved, after which the automatic control shuts off the vibrator, the feeder screw and the grinder and turns on the oil burner so as to maintain pressure. When no steam is consumed, the burner is shut off completely.

In order to be able to be used in the operation of the shop and be able to be fueled solely or mainly by fuel oil when the amount of rubber waste is insufficient, the oil burner has two adjustable positions regulated by electric valves, said positions being controlled by the steam pressure. The plant has both manual and automatic control, all control being steered from a control case containing circuit breakers, contactors, signal lamps, warning lamps and emergency breakers.

The shift between high load and low load takes place with pressure monitors on the boiler which open and close a magnetic valve with subsequent choking in the oil conduit. A shunt conduit with low load choke is parallelly coupled to the magnetic valve. An air controlled on-off damper with adjustable end positions controls the amount of combustion air to the high load and low load respectively.

The transition from pure oil combustion to combustion with rubber dross is effected by a switch in the control case. In the same manner, as previously, boiler pressure controls the furnace between high load and low load, but instead of opening the high load magnetic valve for the oil, the rubber handling plant is started and provides the furnace with rubber corresponding to the high load oil amount.

The foregoing plant was operated at oxygen excesses of 1, 3.5 and 7% and the emissions from chimney 14 measured. Rubber particles of 0.5–2 mm were injected at a rate of 35 kg/hr. The transport fan 6 provided 30°

C. air at a pressure of 300 mm wc and a volume flow rate of 100 $Nm^3/h$ (max. 150 $Nm^3/h$). Air at 50° C. was injected into furnace 7 through register 17.

When operated at 1% $O_2$ excess, register air was provided at a pressure of 700 mm wc and a flow rate of 290 $Nm^3/hr$ (max. 550 $Nm^3/h$). The percentage of stoichiometrically required air and calculated combustion zone gas temperature were 46% and 1060° C. in the ignition zone section of furnace 7, 65% and 1160° C. in the main combustion zone of furnace 7, 100% and 1310° C. in opening 20 and 105% (1% excess $O_2$) and 1400° C. in boiler 9. The temperature of the furnace wall adjacent opening 20 was estimated to be 1050° C. The chimney exhaust gas analysis showed:

| | |
|---|---|
| Temperature | 270° C. |
| $O_2$ | 1% |
| $CO_2$ | 14.5% |
| CO | ca. 0% |
| HC | <10 ppm |
| NOx | 130 ppm (94 ppm adjusted to 10% $CO_2$) |

When operated at 3.5% $O_2$ excess, register air was provided at a pressure of 1000 mm wc and a flow rate of 350 $Nm^3/h$ (max. 550 $Nm^3/h$). The percentage of stoichiometrically required air and calculated combustion zone gas temperatures were 50% and 1160° C., in the ignition zone section of furnace 7, 73% and 1250° C. in the main combustion zone of furnace 7, 100% and 1350° C. in opening 20 and 120% (3.5% excess $O_2$) and 1350° C. in boiler 9. The temperature of the furnace wall adjacent opening 20 was estimated to be 1000° C. The chimney exhaust gas analysis showed:

| | |
|---|---|
| Temperature | 260° C. |
| $O_2$ | 3.5% |
| $CO_2$ | 12.7% |
| CO | ca. 0% |
| HC | <10 ppm |
| NOx | 115 ppm (95 ppm adusted to 10% $CO_2$) |
| Burning Efficiency | 99.76% |

When operated at 7% $O_2$ excess, register air was provided at a pressure of 1560 mm wc and a flow rate of 540 $Nm^3/h$ (max. 550 $Nm^3/h$). The percentage of stoichiometrically required air and calculated combustion zone gas temperatures were 63% and 1160° C., in the ignition zone section of furnace 7, 98% and 1250° C. In the main combustion zone of furnace 7, 100% and 1250° C., in opening 20 and 145% (7% $O_2$ excess) and 1250° C. in boiler 9. The temperature of the furnace wall adjacent opening 20 was estimated to be 950° C. The chimney exhaust gas analysis showed:

| | |
|---|---|
| Temperature | 240° C. |
| $O_2$ | 7% |
| $CO_2$ | 10% |
| CO | ca. 0% |
| HC | <10 ppm |
| NOx | 130 ppm |

What is claimed is:

1. A method of incinerating relatively incombustible, slow burning rubber and plastic wastes comprising the steps of finely dividing the waste into small particles in a grinder, mixing the particles with air into a suspension, blowing the suspension into a cyclone-type furnace, introducing additional oxygen sufficient to provide an excess of about 1 to 7% of the stoichiometric amount of oxygen for combustion into the furnace, dividing the additional oxygen such that a portion thereof mixes with the suspension and the resulting mixture contains a deficiency of stoichiometrically required oxygen for combustion, retaining the particles for a long period of stay in the furnace by directing said mixture to assume a helical movement within said furnace and keeping the particles under heavy turbulence until almost completely incineration of the particles in the furnace, tangentially conveying the almost completely incinerated particles and the remaining portion of the additional oxygen out of the furnace into a steam boiler with sufficient mixing thereof to provide at least about the stoichiometric amount of combustion oxygen, completing incineration of the particles in the boiler removing heat from the incineration mixture in the boiler and generating steam using the heat removed, conveying the flue gases out of the boiler and purifying the flue gases in a cyclone purifier.

2. The method of claim 1 wherein an hour-glass shaped screen is positioned along the longitudinal axis of the furnace near the point that the suspension is blown into the furnace and the additional oxygen is introduced into the furnace and flows around the screen.

3. The method of claim 2 wherein the conveying out of the furnace into the steam boiler is effected through a choke opening having a reduced cross-section relative to the cross-section of the furnace.

4. The method of claim 3 in which the furnace is provided with a burner and the operation of the burner is regulated in response to the pressure of the steam generated.

5. The method of claim 4 further comprising the step of adding waste to be incinerated in response to the higher demand for generated steam.

6. The method of claim 5 further comprising the step of pre-heating the additional oxygen before mixing with the suspension.

7. The method of claim 1 in which the dividing step comprises dividing the particles to a maximum size of 1.5 to 2.0 mm.

* * * * *